US005140780A

United States Patent [19]

Lincoln

[11] Patent Number: 5,140,780

[45] Date of Patent: Aug. 25, 1992

[54] METHOD AND APPARATUS FOR CLEANING AND COOLING A MACHINE TOOL AND WORKPIECE

[75] Inventor: Herbert Lincoln, Oscoda, Mich.

[73] Assignee: Star Cutter Company, Farmington Hills, Mich.

[21] Appl. No.: 745,053

[22] Filed: Aug. 12, 1991

[51] Int. Cl.[5] ..... B24B 55/02
[52] U.S. Cl. ..... 51/267
[58] Field of Search ..... 51/266, 267

[56] References Cited

U.S. PATENT DOCUMENTS

| | | | |
|---|---|---|---|
| 2,462,710 | 2/1949 | Ballinger | 51/267 |
| 3,127,886 | 4/1964 | Miller | 51/267 |
| 3,256,647 | 6/1966 | Hutton | 51/267 |

FOREIGN PATENT DOCUMENTS

| | | | |
|---|---|---|---|
| 2131489 | 2/1972 | Fed. Rep. of Germany | 51/267 |
| 0593566 | 5/1959 | Italy | 51/267 |
| 0990485 | 1/1983 | U.S.S.R. | 51/267 |
| 0907934 | 10/1962 | United Kingdom | 51/267 |

*Primary Examiner*—Roscoe V. Parker
*Attorney, Agent, or Firm*—Harness, Dickey & Pierce

[57] ABSTRACT

A method and apparatus is disclosed for cleaning and cooling a machine tool and workpiece in which a housing substantially surrounds the machine tool and closely conforms to the tool. A high pressure coolant spray is directed from the housing against the working surface of the rotating machine tool to clean the tool afterwhich the rotation of the machine tool within the close confinement of the housing sprays the coolant from the housing onto the workpiece where it serves to cool and lubricate the workpiece.

6 Claims, 3 Drawing Sheets

METHOD AND APPARATUS FOR CLEANING AND COOLING A MACHINE TOOL AND WORKPIECE

BACKGROUND AND SUMMARY OF THE INVENTION

The present invention relates to an apparatus for delivering coolant to a rotary machine tool and in particular to an apparatus that directs the coolant to the machine tool first for cleaning the tool afterwhich the coolant is sprayed upon the workpiece to cool and lubricate the workpiece and machine tool.

While performing a material removal operation, grinding for example, it is necessary to provide a coolant to both cool and lubricate the workpiece and the cutting tool. Typically, oil or water based cooling fluids are used for this purpose. The coolant is often supplied to a manifold adjacent to or surrounding the cutting tool which distributes the coolant to one or more outlets from which the coolant is discharged onto the workpiece. With respect to a grinding operation, a coolant flow rate of approximately 30 gallons per minute with a coolant pressure of 30 psi has been used generally satisfactorily to cool the grinding wheel and workpiece. However, during a machining operation, particles of material being removed from the workpiece can accumulate in the cutting tool. This is particularly true with grinding where an abrasive work surface is used to remove very fine particles of material from the workpiece. The particles accumulate in the abrasive work surface, reducing the ability of the abrasive to remove material. This accumulation is typically referred to as a "load". When a significant load has been accumulated, grinding performance is decreased and eventually the grinding wheel must be replaced.

Accordingly, it is an object of the present invention to provide an apparatus for cleaning the load from a machine tool such as a grinding wheel to thereby extend the useful life of the tool.

It is a feature of the present invention to provide a housing closely surrounding the machine tool with a portion of the tool extending from the housing to engage the workpiece. The housing is provided with one or more small outlet orifices through which a coolant spray is projected at a high pressure against the work surface of the tool. The impact of the coolant spray against the tool removes the load from the work surface thereby cleaning the tool. The housing is contoured to the tool and closely spaced therefrom to provide minimal clearance for drainage of the coolant. The coolant is thus forced to remain in close contact with the rotating tool and is then forced by the rotating tool and housing against the workpiece where the coolant serves to cool and lubricate the workpiece.

It is an advantage of the present invention that cooling is improved enabling the coolant flow rate to be reduced.

It is a further advantage of the present invention that the rate of metal removal can be increased while the life of the work tool is also increased.

Further objects, features and advantages of the invention will become apparent from a consideration of the following description and the appended claims when taken in conjunction with the accompanying drawings.

DETAILED DESCRIPTION OF THE INVENTION

Figure 1:
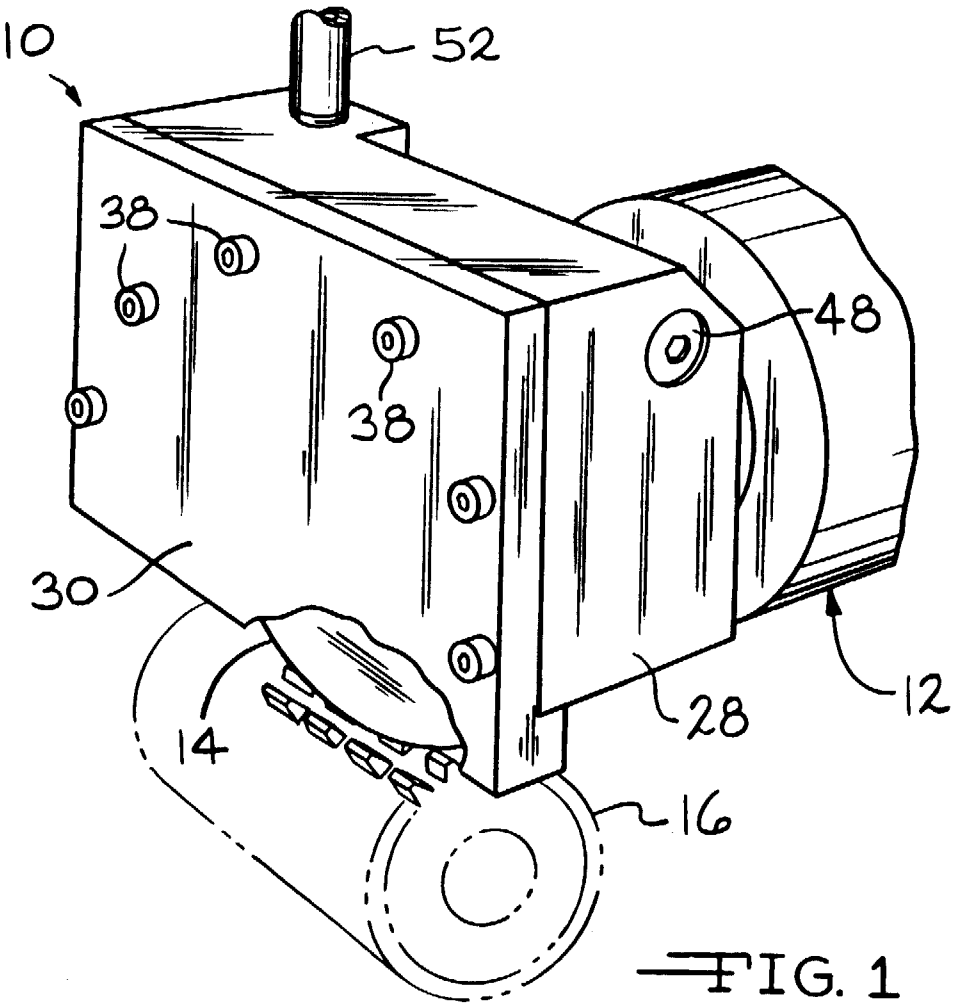
FIG. 1 is a perspective view of the housing of the present invention shown in connection with a grinding wheel.
Figure 2:
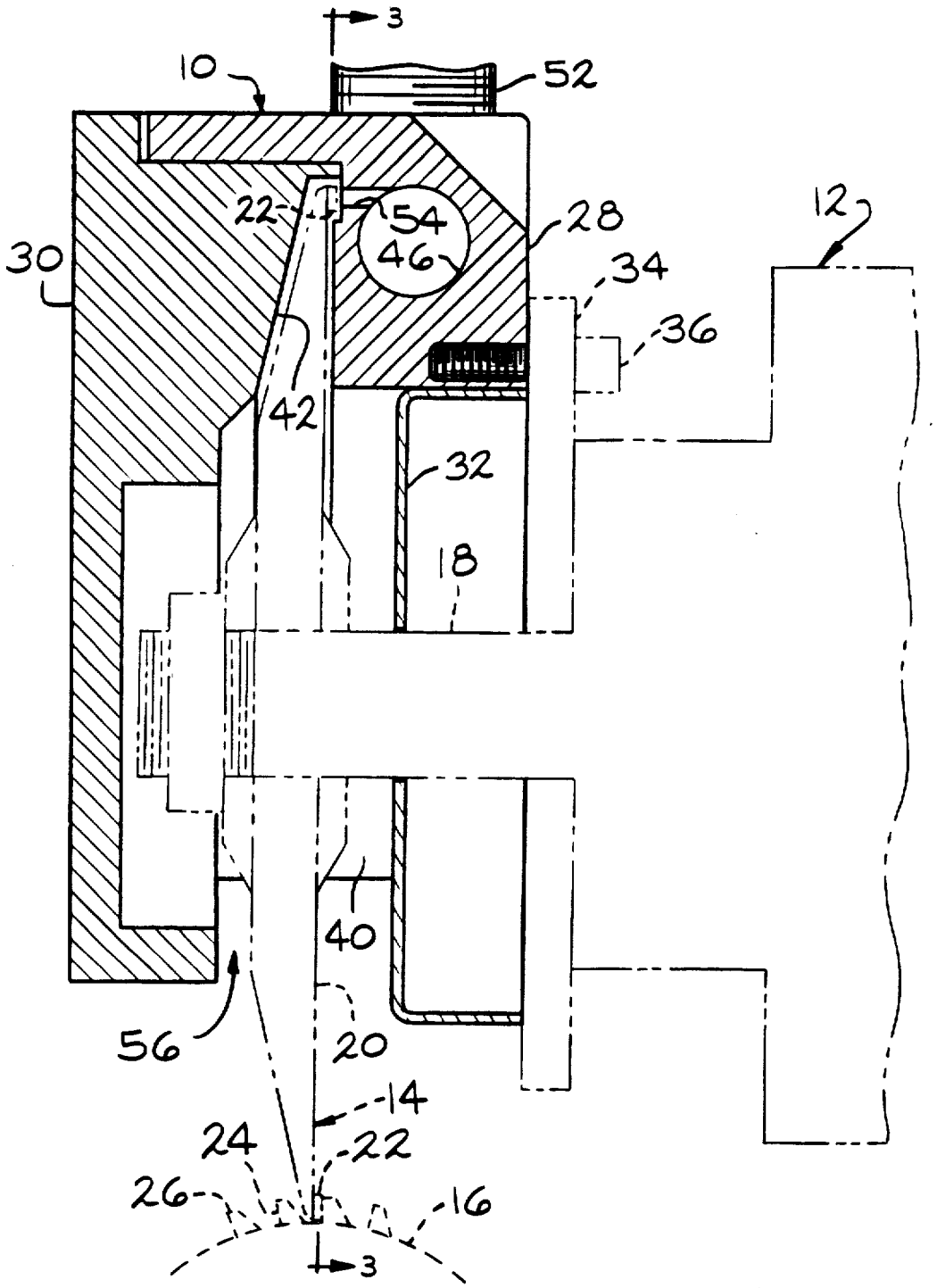
FIG. 2 is a vertical sectional view of the housing shown in FIG. 1.

The present invention is shown in FIG. 1 in the form of a housing 10 mounted to a grinding machine 12. The housing 10 substantially surrounds a grinding wheel 14 shown in use sharpening the teeth of hob 16. Grinding wheel 14 is mounted for rotation to the spindle 18 of machine 12 and includes a flat inner face 20 with an abrasive 22 carried at the periphery of the grinding wheel. By rotating the spindle 18 and grinding wheel 14, the abrasive 22 is used to sharpen the face 24 of the hob teeth 26. The particular application of the invention shown is in the context of a grinding operation for illustrative purposes only. The invention is not limited to any particular machine tool or application. However, the invention may have its greatest utility with grinding or polishing machines where abrasives are used.

Housing 10 is a multiple piece structure having a main body 28, cover 30 and spacer 32. The main body 28 is mounted to the flange 34 of the machine 12 by bolts 36. Cover 30 is mounted to the main body 28 by a plurality of bolts 38. The spacer 32 is friction fit within a circular opening 40 formed in the main body 28.

The main body 28 and cover 30 cooperate to form a cavity 42 that is contoured to the shape of grinding wheel 14, especially the peripheral portion of the grinding wheel, and is closely spaced from the grinding wheel. The surface of cavity 42 is spaced approximately 1/16 to ⅛ of an inch from the grinding wheel.

The housing 10 serves as a manifold for the coolant and includes a coolant distribution passage 46 extending through the main body 28. Plugs 48 are installed in each end of the passage 46 to close the passage at the ends of the housing. A supply passage 50 in the top of the housing enables a coolant supply hose 52 to be coupled with the passage 46 providing coolant to the housing manifold. A plurality of orifices 54 extend between the supply passage 46 to the cavity 42 directing coolant sprays from the supply passage 46 against the work surface or abrasive portion 22 of the grinding wheel.

In order to increase the coolant pressure, the machine 12 is equipped with a positive displacement pump for circulating the coolant to the housing 10. To develop the necessary pressure, the orifices 54 are of a relatively small diameter such as ⅛ inch. The small size orifice 54 in combination with a positive displacement pump enables a coolant pressure in excess of 100 psi to be developed. As the coolant flows through the orifices 54 and is sprayed against the abrasive 22, the shear forces created by the coolant spray perpendicular to the path of travel of the rotating grinding wheel acts to remove the accumulated load within the abrasive material. Once the abrasive has been cleaned, the coolant drains downward through cavity 42 and from the housing through the open bottom portion 56. As the coolant attempts to drain from the housing, the rotation of the grinding wheel forces the coolant centrifugally away from the wheel. However, the housing which surrounds a majority of the wheel keeps the coolant in close contact with the grinding wheel. As a result, the coolant travels around the housing with the grinding wheel and is only allowed to spray away from the wheel at the open portion 56 at the base of the housing. The hob 16 or workpiece is positioned below the housing open portion 56 so that the coolant spray from the housing is directed against the workpiece. By spraying the coolant onto the workpiece, it acts to lubricate and cool the workpiece during the grinding operation. Spacer 32 is used to reduce the size of the cavity 42 surrounding the machine spindle 18.

Figure 3:
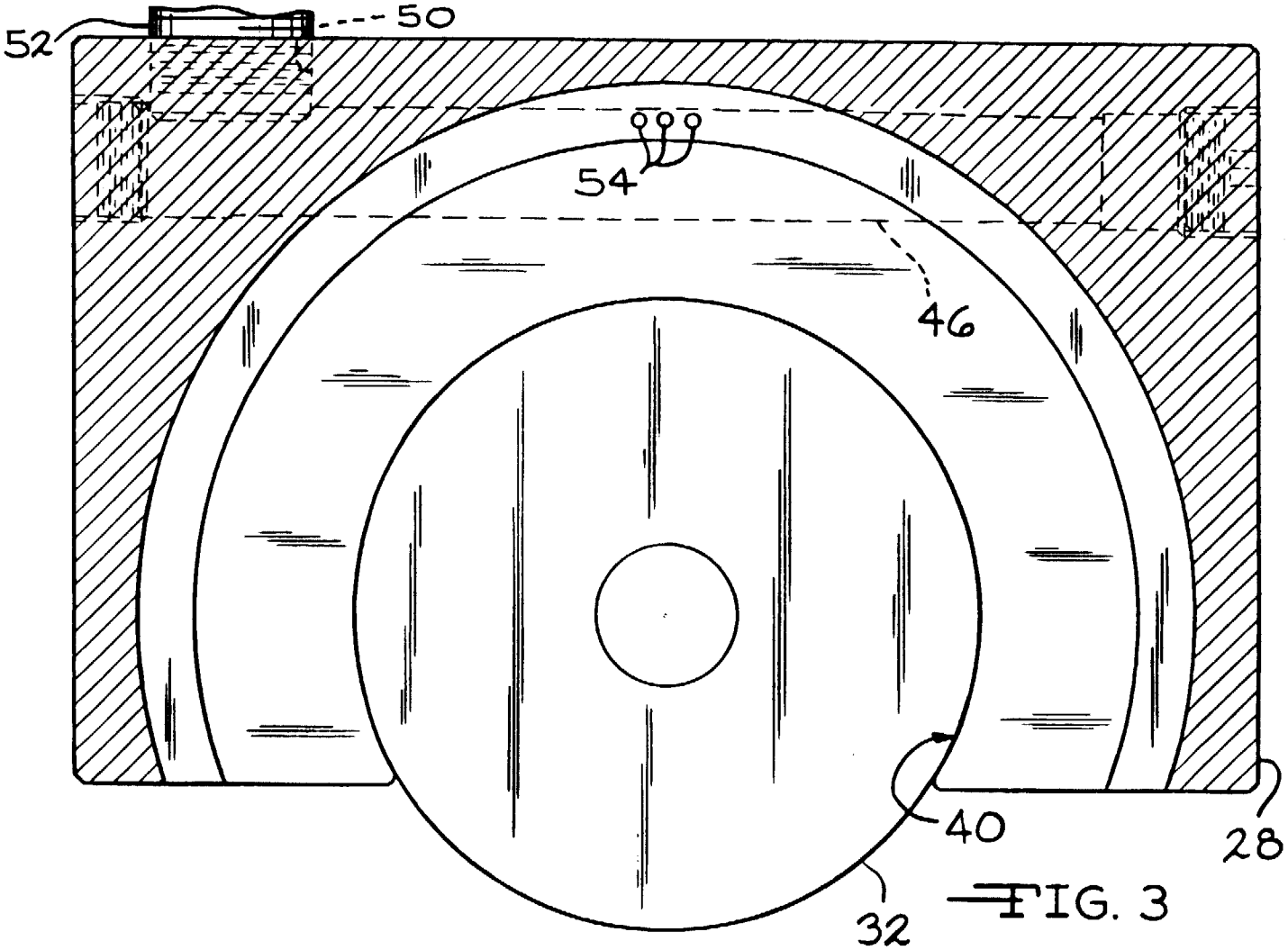
FIG. 3 is a sectional view as seen from substantially the line 3—3 of FIG. 2.

The system produces improved cooling of the workpiece enabling the cooling flow rate to be significantly decreased from the flow rate used previously with a low pressure coolant system. In addition, by maintaining the grinding wheel abrasive in a clean condition the wheel life is extended and the rate of material removal can be increased. In one installation, three ⅛ inch diameter orifices were used as shown in FIG. 3. With a pump pressure of 130–140 psi, a coolant flow rate of approximately 11 gallons per minute is produced. The grinding wheel life was increased and the hobs were noticeably cooler after grinding.

The coolant system of the present invention is particularly useful with the recently developed super abrasives such as diamond, CBN and borzon, when used to finish grind hardened steel.

It is to be understood that the invention is not limited to the exact construction or method illustrated and described above, but that various changes and modifications may be made without departing from the spirit and scope of the invention as defined in the following claims.

I claim:

1. A coolant system for a machine having a rotating disc with an abrasive work surface at the periphery of said disc for performing a material removal operation on a workpiece, said coolant system comprising:

a housing surrounding a portion of said disc and having an open end through which said disc projects from said housing, said housing being spaced from said disc no more than one eighth of an inch; and said housing having at least one coolant outlet orifice positioned to direct a spray of coolant onto the disc work surface at a location rotationally spaced from the workpiece for cleaning said abrasive work surface, said coolant remaining in close contact with said rotating disc due to the close spacing of said housing and said disc whereby said coolant is forced through the housing open end against said workpiece to cool said workpiece at the location of material removal by said disc.

2. The coolant system of claim 1 wherein said at least one coolant outlet orifice is positioned to direct a coolant spray at the work surface substantially perpendicularly to the path of travel of the work surface as the disc is rotated.

3. The coolant system of claim 1 wherein said housing surrounds more than one half of the disc.

4. The coolant system of claim 1 further comprising a positive displacement pump for said coolant and wherein said at least one coolant outlet orifice is sized to produce a coolant pressure in excess of 100 psi.

5. A coolant system for a machine having a rotating disc with an abrasive work surface at the periphery of said disc for performing a material removal operation on a workpiece, said coolant system comprising:

a housing surrounding a portion of said disc and having an open end through which said disc projects from said housing, said housing conforming to said disc and being spaced from said disc no more than ⅛th of an inch;

said housing having at least one coolant outlet orifice positioned to direct a spray of coolant perpendicularly onto the disc work surface at a location rotationally spaced from the workpiece for cleaning the abrasive surface, said coolant remaining in contact with said rotating disc due to the close spacing of said housing to said disc whereby said coolant is forced by said disc through the housing open end against said workpiece to cool said workpiece at the location of material removal by said disc;

a positive displacement pump for pumping said coolant; and said at least one coolant outlet orifice being sized to produce a coolant pressure in excess of 100 psi.

6. A method of cleaning a rotating grinding wheel having an abrasive work surface at the periphery thereof and cooling a workpiece being ground by the grinding wheel comprising the steps of:

surrounding a portion of the grinding wheel with a housing contoured to and spaced from said grinding wheel by less than ⅛ of an inch with a portion of the wheel projecting from said housing to a grinding location;

directing a stream of coolant against the work surface of the grinding wheel within said housing to clean the work surface; and draining the coolant from said housing while the coolant is in contact with the grinding wheel whereby the wheel sprays the coolant onto the workpiece to cool said workpiece.

* * * * *